US011242767B2

(12) United States Patent
Wilson et al.

(10) Patent No.: US 11,242,767 B2
(45) Date of Patent: Feb. 8, 2022

(54) ADDITIVELY MANUFACTURED COMPONENT INCLUDING AN IMPINGEMENT STRUCTURE

(71) Applicant: General Electric Company, Schenectady, NY (US)

(72) Inventors: Gregg Hunt Wilson, Cincinnati, OH (US); Stephen Joseph Waymeyer, Batavia, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 609 days.

(21) Appl. No.: 15/582,895

(22) Filed: May 1, 2017

(65) Prior Publication Data

US 2018/0313227 A1 Nov. 1, 2018

(51) Int. Cl.

| | |
|---|---|
| ***F01D 25/24*** | (2006.01) |
| ***F04D 29/52*** | (2006.01) |
| ***F01D 25/14*** | (2006.01) |
| ***F01D 25/26*** | (2006.01) |
| ***F01D 25/12*** | (2006.01) |
| ***F04D 29/58*** | (2006.01) |
| ***F01D 25/10*** | (2006.01) |

(52) U.S. Cl.

CPC ..... *F01D 25/12* (2013.01); *F01D 25/10* (2013.01); *F01D 25/14* (2013.01); *F01D 25/24* (2013.01); *F01D 25/26* (2013.01); *F04D 29/522* (2013.01); *F04D 29/582* (2013.01); *F05D 2220/32* (2013.01); *F05D 2230/30* (2013.01); *F05D 2230/53* (2013.01); *F05D 2240/14* (2013.01); *F05D 2260/201* (2013.01)

(58) Field of Classification Search

None

See application file for complete search history.

(56) References Cited

U.S. PATENT DOCUMENTS

| | | | | |
|---|---|---|---|---|
| 3,981,466 | A * | 9/1976 | Shah | B64D 15/02 244/134 R |
| 5,041,323 | A * | 8/1991 | Rose | B32B 3/12 428/116 |
| 6,371,242 | B1 * | 4/2002 | Wilson | B32B 3/12 181/210 |

(Continued)

OTHER PUBLICATIONS

First Office Action of CN201810394187.6 dated Mar. 18, 2020.

*Primary Examiner* — Peter J Bertheaud
*Assistant Examiner* — Geoffrey S Lee
(74) *Attorney, Agent, or Firm* — Hanley, Flight & Zimmerman, LLC

(57) ABSTRACT

An additively manufactured impingement structure for a component is provided. The control structure includes an outer wall, an inner wall, and an impingement wall positioned between the outer wall and the inner wall. A fluid distribution passageway is defined between the inner wall and the impingement wall and an impingement gap is defined between the impingement wall and the outer wall. A plurality of impingement holes are defined in the impingement wall to provide fluid communication between the fluid distribution passageway and the impingement gap. A flow of cooling or heating fluid may be supplied to the fluid distribution passageway which distributes the flow and impinges it through the impingement holes onto the outer wall to cool or heat the outer wall, respectively.

17 Claims, 9 Drawing Sheets

(56) References Cited

U.S. PATENT DOCUMENTS

| | | | | |
|---|---|---|---|---|
| 7,291,815 | B2 * | 11/2007 | Hubert | B64D 15/12 219/529 |
| 7,923,668 | B2 * | 4/2011 | Layland | B64D 15/12 219/529 |
| 8,230,969 | B2 * | 7/2012 | Frederick | E04B 1/86 181/284 |
| 8,793,871 | B2 | 8/2014 | Morrison et al. | |
| 2002/0179773 | A1 * | 12/2002 | Breer | B64D 15/04 244/134 R |
| 2003/0098200 | A1 * | 5/2003 | Clark | F24F 13/02 181/292 |
| 2011/0214431 | A1 * | 9/2011 | Benkler | F01D 9/04 60/772 |
| 2011/0262695 | A1 | 10/2011 | Lee et al. | |
| 2012/0243970 | A1 * | 9/2012 | Hellgren | F01K 27/02 415/1 |
| 2014/0216042 | A1 | 8/2014 | Hanson | |
| 2015/0226085 | A1 | 8/2015 | Spangler et al. | |
| 2015/0226433 | A1 | 8/2015 | Dudebout et al. | |
| 2015/0241062 | A1 | 8/2015 | Harding | |
| 2016/0010863 | A1 | 1/2016 | Ott et al. | |

* cited by examiner

ADDITIVELY MANUFACTURED COMPONENT INCLUDING AN IMPINGEMENT STRUCTURE

FIELD

The present subject matter relates generally to impingement structures, and more particularly, to additively manufactured components for gas turbine engines that include impingement structures for controlling the temperature of the component.

BACKGROUND

A core of a gas turbine engine generally includes, in serial flow order, a compressor section, a combustion section, a turbine section, and an exhaust section. In operation, air is provided to an inlet of the compressor section where one or more axial compressors progressively compress the air until it reaches the combustion section. Fuel is mixed with the compressed air and burned within the combustion section to provide combustion gases. The combustion gases are routed from the combustion section to the turbine section. The flow of combustion gases through the turbine section drives the turbine section and is then routed through the exhaust section, e.g., to atmosphere.

During operation of the gas turbine engine, various components may experience extreme temperature gradients which may result in operational issues if not controlled. For example, a center body of the inlet may be exposed to very cold air during high altitude or cold environment operation, resulting in ice build-up. Similarly, a turbine case that is exposed to very high temperatures may grow in size relative to the turbine rotor blades due to thermal expansion, causing turbine efficiency losses or other operational issues. Various conventional systems and methods are used for controlling the temperatures of such components, e.g., by routing heated air to the heat the center body and prevent ice formation and by routing cool air to the turbine case to prevent excessive thermal expansion. However, such methods of controlling the temperature of such components often require complicated plumbing and multi-part assemblies that are both inefficient and increase the likelihood of leaks or other component failures.

Accordingly, a component including features for delivering heating or cooling air to select portions of the component would be useful. More specifically, an additively manufactured component of a gas turbine engine including impingement structures for controlling localized component temperatures would be particularly beneficial.

BRIEF DESCRIPTION

Aspects and advantages of the invention will be set forth in part in the following description, or may be obvious from the description, or may be learned through practice of the invention.

In one exemplary embodiment of the present disclosure, a component is provided including an outer wall and an inner wall spaced apart from the outer wall. An impingement wall is positioned between the outer wall and the inner wall, a fluid distribution passageway is defined between the inner wall and the impingement wall, and an impingement gap is defined between the impingement wall and the outer wall. A plurality of impingement holes is defined in the impingement wall, the impingement holes providing fluid communication between the fluid distribution passageway and the impingement gap. The outer wall, the impingement wall, and the inner wall are integrally formed as a single monolithic component.

In another exemplary aspect of the present disclosure, a component defining an axial direction is provided. The component includes one or more inlet conduits defining one or more inlet passageways. An annular distribution ring is formed about the axial direction and defining an annular plenum in fluid communication with the inlet passageways. A plurality of inner fluid conduits extend from the annular distribution ring and being defined at least in part by an impingement wall, each inner fluid conduit defining a fluid distribution passageway in fluid communication with the annular plenum. A plurality of outer fluid conduits extend from the annular distribution ring and are defined at least in part by the impingement wall and an outer wall, each of the outer fluid conduits defining an impingement gap. A plurality of impingement holes are defined in the impingement wall, the impingement holes providing fluid communication between the fluid distribution passageways and the impingement gaps.

In still another exemplary aspect of the present disclosure, a method of manufacturing a component is provided. The method includes depositing a layer of additive material on a bed of an additive manufacturing machine and selectively directing energy from an energy source onto the layer of additive material to fuse a portion of the additive material and form the component. The component includes an outer wall and an inner wall spaced apart from the outer wall. An impingement wall is positioned between the outer wall and the inner wall, a fluid distribution passageway being defined between the inner wall and the impingement wall and an impingement gap being defined between the impingement wall and the outer wall. A plurality of impingement holes are defined in the impingement wall, the impingement holes providing fluid communication between the fluid distribution passageway and the impingement gap.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
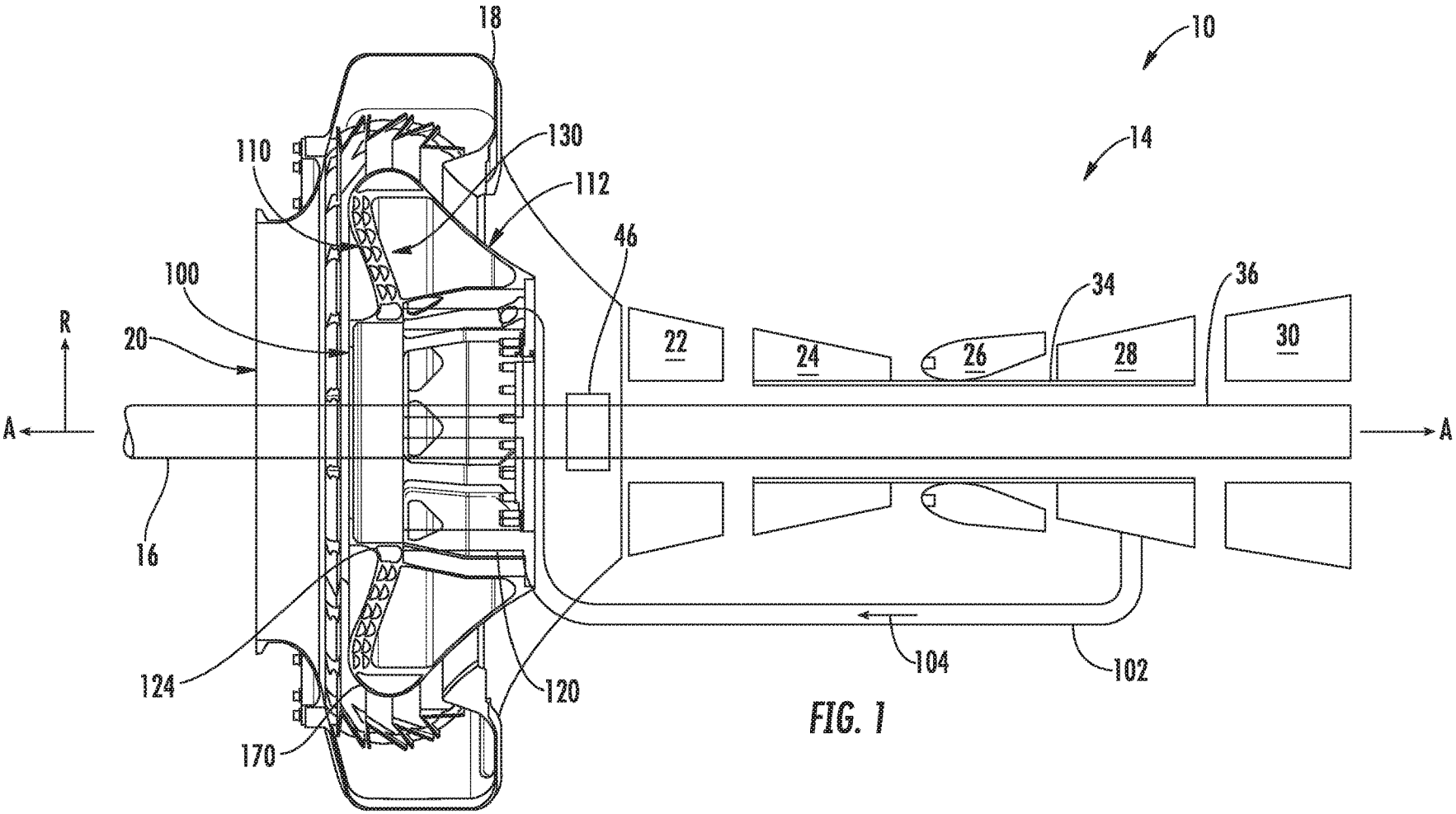
FIG. 1 is a schematic cross-sectional view of an exemplary gas turbine engine according to various embodiments of the present subject matter.

Repeat use of reference characters in the present specification and drawings is intended to represent the same or analogous features or elements of the present invention.

DETAILED DESCRIPTION

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The present disclosure is generally directed to an additively manufactured impingement structure for a component. The control structure includes an outer wall, an inner wall, and an impingement wall positioned between the outer wall and the inner wall. A fluid distribution passageway is defined between the inner wall and the impingement wall and an impingement gap is defined between the impingement wall and the outer wall. A plurality of impingement holes are defined in the impingement wall to provide fluid communication between the fluid distribution passageway and the impingement gap. A flow of cooling or heating fluid may be supplied to the fluid distribution passageway which distributes the flow and impinges it through the impingement holes onto the outer wall to cool or heat the outer wall, respectively.

Referring now to the drawings, FIG. 1 is a schematic cross-sectional view of a gas turbine engine in accordance with an exemplary embodiment of the present disclosure. More particularly, for the embodiment of FIG. 1, the gas turbine engine is a combustion engine configured for generating shaft power, referred to herein as "turboshaft engine 10." As shown in FIG. 1, the turboshaft engine 10 defines an axial direction A (extending parallel to a longitudinal centerline of turboshaft engine 10) and a radial direction R. In general, the turboshaft 10 includes a core turbine engine 14 for rotating a drive shaft 16.

The exemplary core turbine engine 14 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustor or combustion section 26; and a turbine section including a high pressure (HP) turbine 28 and a low pressure (LP) turbine 30. A high pressure (HP) shaft or spool 34 drivingly connects the HP turbine 28 to the HP compressor 24. A low pressure (LP) shaft or spool 36 drivingly connects the LP turbine 30 to the LP compressor 22. For the embodiment depicted, drive shaft 16 is together rotatable about the axial direction by LP shaft 36 across a power gear box 46. The power gear box 46 includes a plurality of gears for stepping down the rotational speed of the LP shaft 36 to a more efficient rotational drive shaft 16 speed and is attached to a core frame through one or more coupling systems.

During operation of the turboshaft engine 10, a volume of air enters the turboshaft 10 through inlet 20. The flow of air is directed or routed into the LP compressor 22 where the pressure is increased as it is routed through the high pressure (HP) compressor 24. In the combustion section 26, the compressed air is mixed with fuel and burned to provide combustion gases. The combustion gases are routed through the HP turbine 28 where a portion of thermal and/or kinetic energy from the combustion gases is extracted via sequential stages of HP turbine stator vanes that are coupled to the outer casing 18 and HP turbine rotor blades that are coupled to the HP shaft or spool 34, thus causing the HP shaft or spool 34 to rotate, thereby supporting operation of the HP compressor 24. The combustion gases are then routed through the LP turbine 30 where a second portion of thermal and kinetic energy is extracted from the combustion gases via sequential stages of LP turbine stator vanes that are coupled to the outer casing 18 and LP turbine rotor blades that are coupled to the LP shaft or spool 36, thus causing the LP shaft or spool 36 to rotate, thereby supporting operation of the LP compressor 22 and/or rotation of drive shaft 16.

It should be appreciated that the exemplary turboshaft 10 depicted in FIG. 1 is by way of example only and that in other exemplary embodiments, turboshaft 10 may have any other suitable configuration. For example, it should be appreciated that in other exemplary embodiments, turboshaft 10 may instead be configured as any other suitable turbine engine, such as a turbofan engine, turboprop engine, turbojet engine, internal combustion engine, etc.

As explained briefly above, turboshaft 10 may include one or more components that require heating or cooling for improved performance. For example, according to the illustrated embodiment, turboshaft 10 includes a center body 100 positioned within inlet 20 of core turbine engine 14. Particularly when operating at high altitudes or in cold environments, air entering inlet 20 can cause ice to form on center body 100, resulting in operational problems. Therefore, as described below, center body 100 may have various features for heating cool surfaces of center body 100 to prevent the formation of ice. Although center body 100 is illustrated as having such features for heating surfaces at risk of ice formation, it should be appreciated that the systems and methods described herein may be used to control the temperature of components throughout turboshaft engine 10. Moreover, aspects of the present subject matter may be applied to heat or cool surfaces in other gas turbine engine applications, or in any other industry.

In general, the exemplary embodiments of center body 100 described herein may be manufactured or formed using any suitable process. However, in accordance with several aspects of the present subject matter, center body 100 may be formed using an additive-manufacturing process, such as a 3-D printing process. The use of such a process may allow center body 100 to be formed integrally, as a single monolithic component, or as any suitable number of sub-components. In particular, the manufacturing process may allow center body 100 to be integrally formed and include a variety of features not possible when using prior manufacturing methods. For example, the additive manufacturing methods described herein enable the manufacture of center body 100 having various features, configurations, thicknesses, materials, densities, and fluid passageways not possible using prior manufacturing methods. Some of these novel features are described herein.

As used herein, the terms "additively manufactured" or "additive manufacturing techniques or processes" refer generally to manufacturing processes wherein successive layers of material(s) are provided on each other to "build-up," layer-by-layer, a three-dimensional component. The successive layers generally fuse together to form a monolithic component which may have a variety of integral subcomponents. Although additive manufacturing technology is described herein as enabling fabrication of complex objects by building objects point-by-point, layer-by-layer, typically in a vertical direction, other methods of fabrication are possible and within the scope of the present subject matter. For example, although the discussion herein refers to the addition of material to form successive layers, one skilled in the art will appreciate that the methods and structures disclosed herein may be practiced with any additive manufacturing technique or manufacturing technology. For example, embodiments of the present invention may use layer-additive processes, layer-subtractive processes, or hybrid processes.

Suitable additive manufacturing techniques in accordance with the present disclosure include, for example, Fused Deposition Modeling (FDM), Selective Laser Sintering (SLS), 3D printing such as by inkjets and laserjets, Sterolithography (SLA), Direct Selective Laser Sintering (DSLS), Electron Beam Sintering (EBS), Electron Beam Melting (EBM), Laser Engineered Net Shaping (LENS), Laser Net Shape Manufacturing (LNSM), Direct Metal Deposition (DMD), Digital Light Processing (DLP), Direct Selective Laser Melting (DSLM), Selective Laser Melting (SLM), Direct Metal Laser Melting (DMLM), and other known processes.

The additive manufacturing processes described herein may be used for forming components using any suitable material. For example, the material may be plastic, metal, concrete, ceramic, polymer, epoxy, photopolymer resin, or any other suitable material that may be in solid, liquid, powder, sheet material, wire, or any other suitable form. More specifically, according to exemplary embodiments of the present subject matter, the additively manufactured components described herein may be formed in part, in whole, or in some combination of materials including but not limited to pure metals, nickel alloys, chrome alloys, titanium, titanium alloys, magnesium, magnesium alloys, aluminum, aluminum alloys, and nickel or cobalt base superalloys (e.g., those available under the name Inconel® available from Special Metals Corporation). These materials are examples of materials suitable for use in the additive manufacturing processes described herein, and may be generally referred to as "additive materials."

In addition, one skilled in the art will appreciate that a variety of materials and methods for bonding those materials may be used and are contemplated as within the scope of the present disclosure. As used herein, references to "fusing" may refer to any suitable process for creating a bonded layer of any of the above materials. For example, if an object is made from polymer, fusing may refer to creating a thermoset bond between polymer materials. If the object is epoxy, the bond may be formed by a crosslinking process. If the material is ceramic, the bond may be formed by a sintering process. If the material is powdered metal, the bond may be formed by a melting or sintering process. One skilled in the art will appreciate that other methods of fusing materials to make a component by additive manufacturing are possible, and the presently disclosed subject matter may be practiced with those methods.

In addition, the additive manufacturing process disclosed herein allows a single component to be formed from multiple materials. Thus, the components described herein may be formed from any suitable mixtures of the above materials. For example, a component may include multiple layers, segments, or parts that are formed using different materials, processes, and/or on different additive manufacturing machines. In this manner, components may be constructed which have different materials and material properties for meeting the demands of any particular application. In addition, although the components described herein are constructed entirely by additive manufacturing processes, it should be appreciated that in alternate embodiments, all or a portion of these components may be formed via casting, machining, and/or any other suitable manufacturing process. Indeed, any suitable combination of materials and manufacturing methods may be used to form these components.

An exemplary additive manufacturing process will now be described. Additive manufacturing processes fabricate components using three-dimensional (3D) information, for example a three-dimensional computer model, of the component. Accordingly, a three-dimensional design model of the component may be defined prior to manufacturing. In this regard, a model or prototype of the component may be scanned to determine the three-dimensional information of the component. As another example, a model of the component may be constructed using a suitable computer aided design (CAD) program to define the three-dimensional design model of the component.

The design model may include 3D numeric coordinates of the entire configuration of the component including both external and internal surfaces of the component. For example, the design model may define the body, the surface, and/or internal passageways such as openings, support structures, etc. In one exemplary embodiment, the three-dimensional design model is converted into a plurality of slices or segments, e.g., along a central (e.g., vertical) axis of the component or any other suitable axis. Each slice may define a thin cross section of the component for a predetermined height of the slice. The plurality of successive cross-sectional slices together form the 3D component. The component is then "built-up" slice-by-slice, or layer-by-layer, until finished.

In this manner, the components described herein may be fabricated using the additive process, or more specifically each layer is successively formed, e.g., by fusing or polymerizing a plastic using laser energy or heat or by sintering or melting metal powder. For example, a particular type of additive manufacturing process may use an energy beam, for example, an electron beam or electromagnetic radiation such as a laser beam, to sinter or melt a powder material. Any suitable laser and laser parameters may be used, including considerations with respect to power, laser beam spot size, and scanning velocity. The build material may be formed by any suitable powder or material selected for enhanced strength, durability, and useful life, particularly at high temperatures.

Each successive layer may be, for example, between about 10 μm and 200 μm, although the thickness may be selected based on any number of parameters and may be any suitable size according to alternative embodiments. Therefore, utilizing the additive formation methods described above, the components described herein may have cross sections as thin as one thickness of an associated powder layer, e.g., 10 μm, utilized during the additive formation process.

In addition, utilizing an additive process, the surface finish and features of the components may vary as need depending on the application. For example, the surface finish may be adjusted (e.g., made smoother or rougher) by selecting appropriate laser scan parameters (e.g., laser power, scan speed, laser focal spot size, etc.) during the additive process, especially in the periphery of a cross-sectional layer which corresponds to the part surface. For example, a rougher finish may be achieved by increasing laser scan speed or decreasing the size of the melt pool formed, and a smoother finish may be achieved by decreasing laser scan speed or increasing the size of the melt pool formed. The scanning pattern and/or laser power can also be changed to change the surface finish in a selected area.

Notably, in exemplary embodiments, several features of the components described herein were previously not possible due to manufacturing restraints. However, the present inventors have advantageously utilized current advances in additive manufacturing techniques to develop exemplary embodiments of such components generally in accordance with the present disclosure. While the present disclosure is not limited to the use of additive manufacturing to form these components generally, additive manufacturing does provide a variety of manufacturing advantages, including ease of manufacturing, reduced cost, greater accuracy, etc.

In this regard, utilizing additive manufacturing methods, even multi-part components may be formed as a single piece of continuous metal, and may thus include fewer sub-components and/or joints compared to prior designs. The integral formation of these multi-part components through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced.

Also, the additive manufacturing methods described above enable much more complex and intricate shapes and contours of the components described herein. For example, such components may include thin additively manufactured layers and fluid passageways having unique sizes, shapes, and orientations. In addition, the additive manufacturing process enables the manufacture of a single component having different materials such that different portions of the component may exhibit different performance characteristics. The successive, additive nature of the manufacturing process enables the construction of these novel features. As a result, the components described herein may exhibit improved operational efficiency and reliability.

Referring now generally to FIGS. 2 through 8, center body 100 will be described according to exemplary embodiments of the present subject matter. It should be appreciated that the exemplary embodiments of center body 100 described herein are used only to describe aspects of the present subject matter. In this regard, for example, the shape, size, position, and orientation of center body 100 and its internal passageways may vary or be modified while remaining within the scope of the present subject matter. In addition, center body 100 may be used in any suitable gas turbine engine or aspects of center body 100 may be used to heat or cool other components in any suitable machine or system.

As explained above, aspects of the present subject matter are directed to methods of heating or cooling surfaces or portions of components to improve operation and performance. Such heating and cooling is typically achieved by supplying a heat exchange fluid to a location where temperature is to be controlled. For example, according to the illustrated embodiment, relatively warm air is bled off of high pressure turbine 28 or low pressure turbine 30 and impinged on center body 100 to increase its temperature at desired locations. Referring again briefly to FIG. 1, turboshaft engine 10 includes a fluid supply pipe 102 for bleeding relatively warm air off of high pressure turbine 28 and routing it to center body 100 (as indicated by arrow 104).

Although the illustrated embodiment describes the heating of center body 100, it should be appreciated that aspects of the present subject matter may be used for heating or cooling any other suitable component. For example, if it is desirable to cool a turbine case of turboshaft engine 10, relatively cool air can be bled off of low pressure compressor 22 or high pressure compressor 24 and impinged on the turbine case, in the same manner as described below. According to another embodiment, it may be desirable to impinge relatively warm air onto a nose cone of a turbofan engine, e.g., to prevent ice build-up in a manner similar to that described herein. Other modifications and variations of the present subject matter may be used in any other suitable application while remaining within the scope of the present subject matter. For example, aspects of the present subject matter may be used to heat or cool a booster casing, a compressor casing, a turbine casing, a frame, or a center body of a gas turbine engine.

Figure 2:
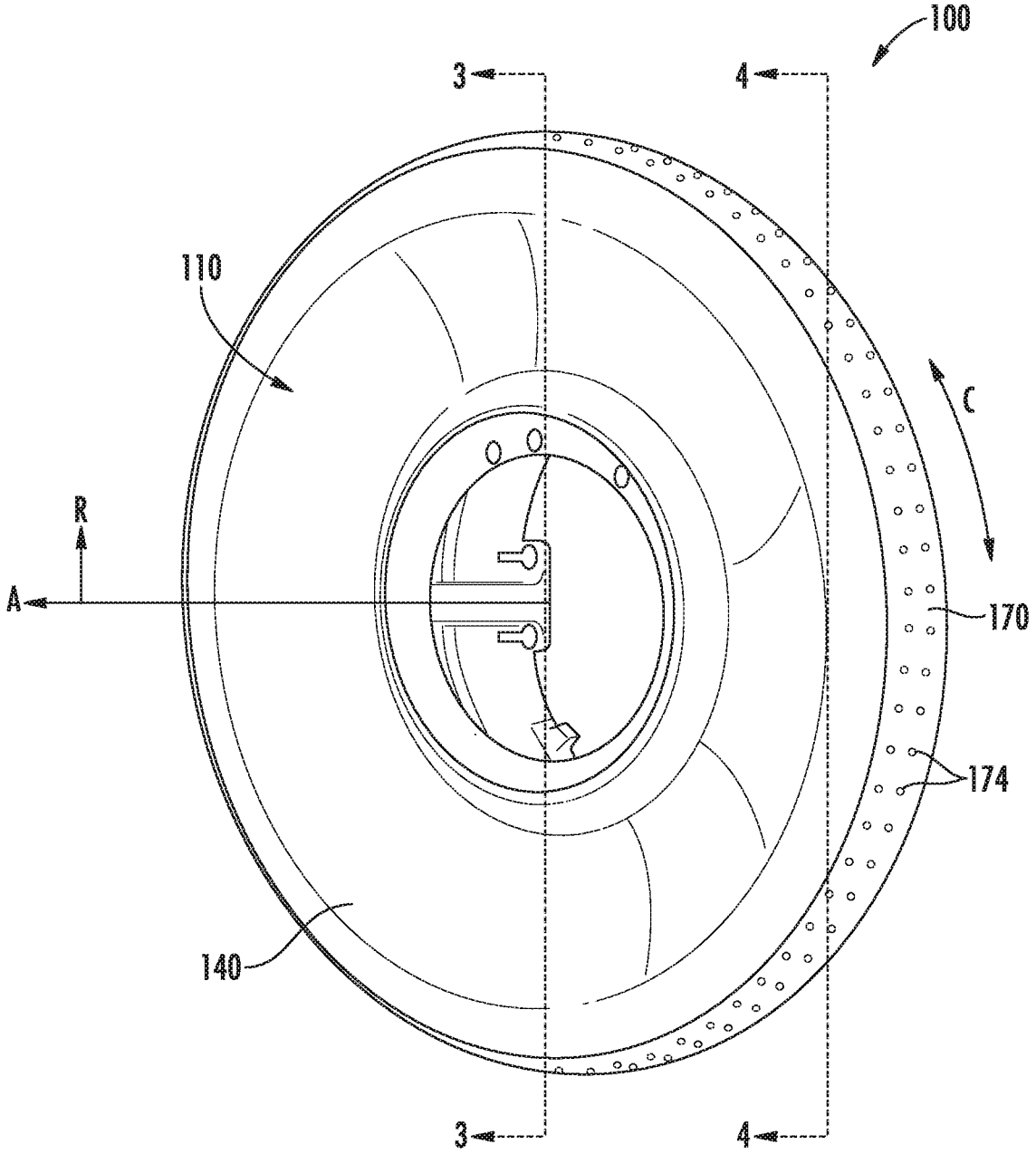
FIG. 2 provides a perspective view of a center body of the exemplary gas turbine engine of FIG. 1 according to an exemplary embodiment of the present subject matter.
Figure 3:
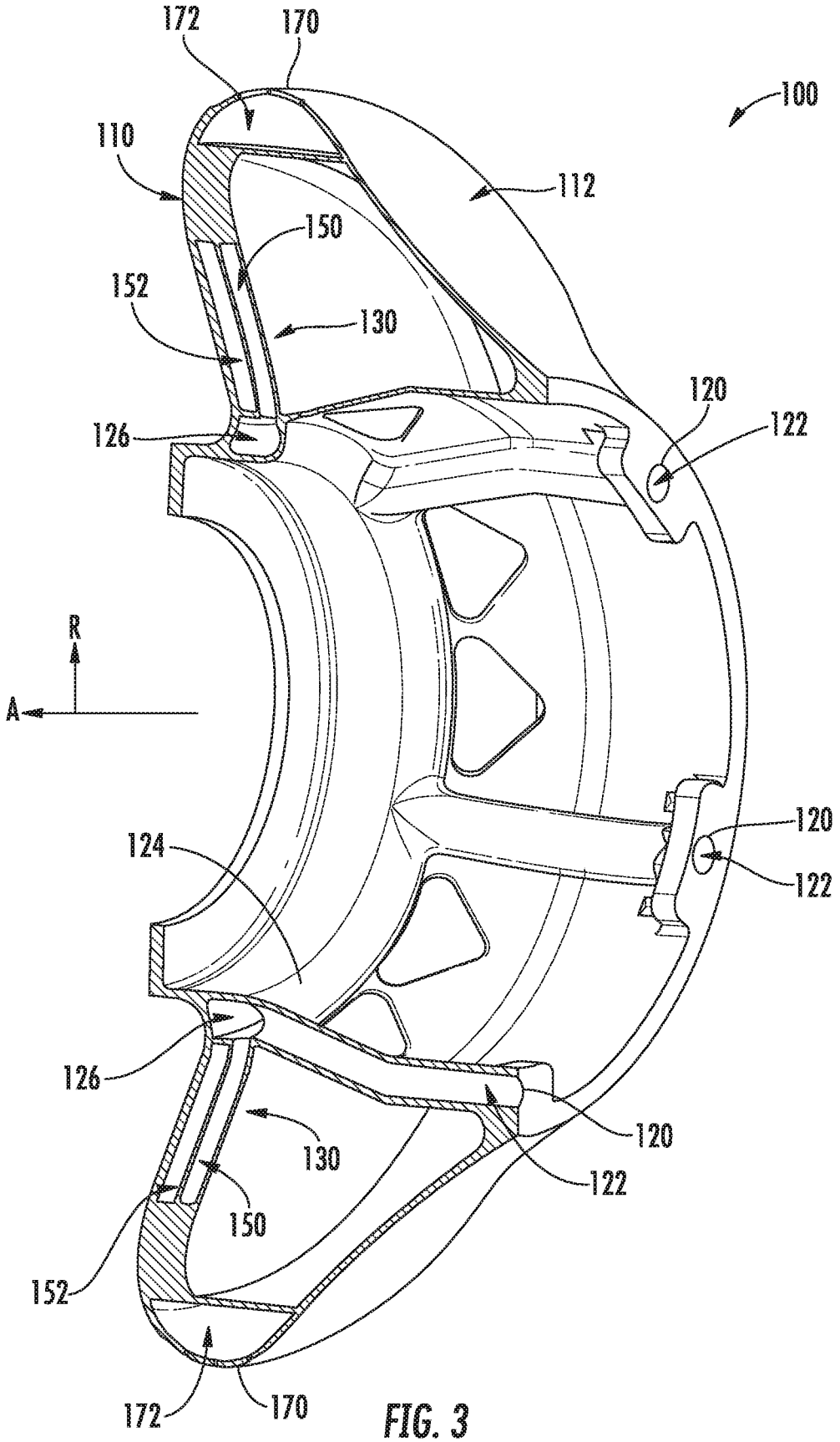
FIG. 3 provides a cross sectional view of the exemplary center body of FIG. 2, taken along Line 3-3 of FIG. 2.
Figure 4:
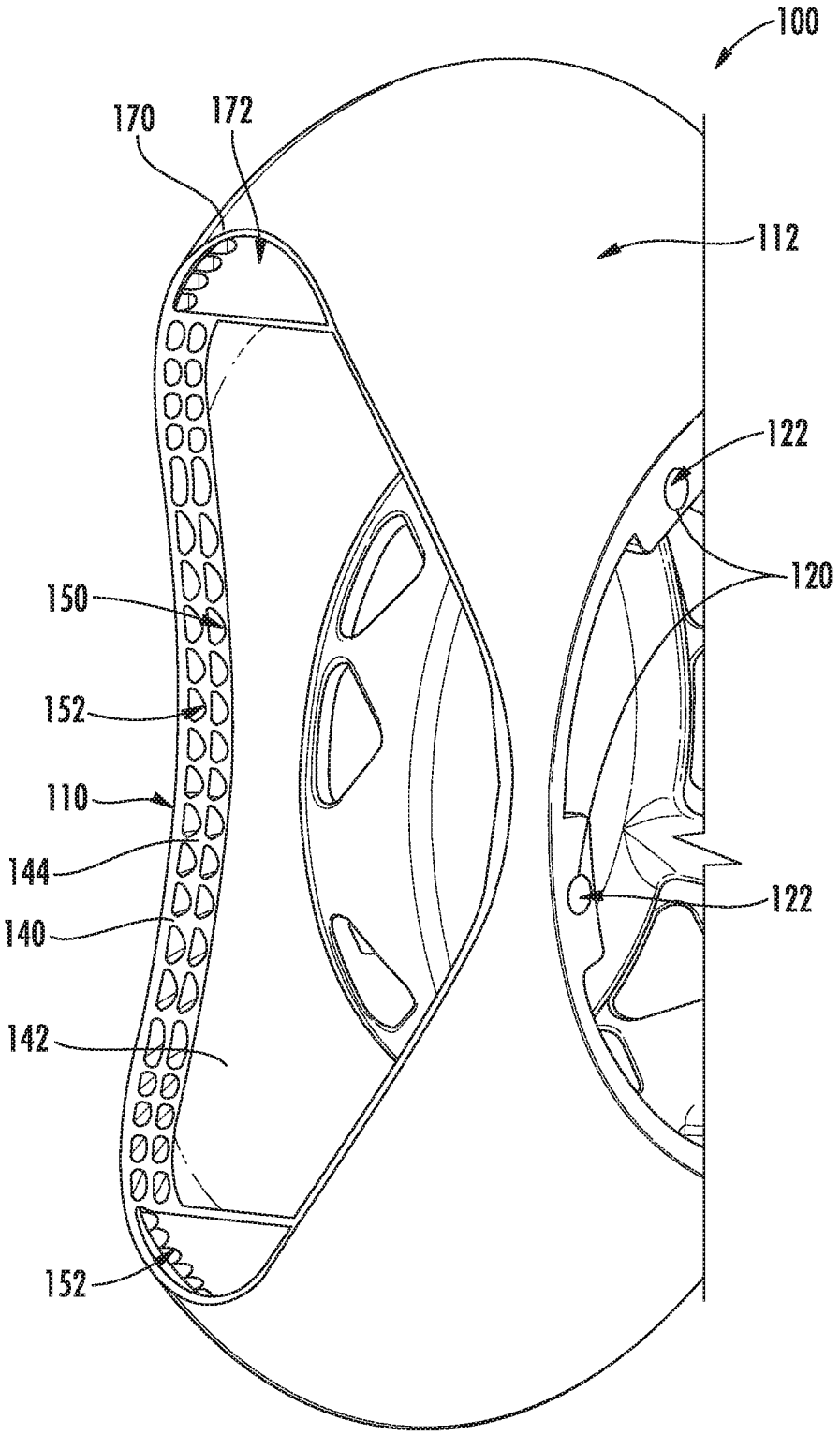
FIG. 4 provides a cross sectional view of the exemplary center body of FIG. 2, taken along Line 4-4 of FIG. 2.

Referring now to FIGS. 2 and 3, center body 100 generally defines a front surface 110 and a rear surface 112 separated along the axial direction A. As illustrated in FIG. 1, center body 100 is positioned within turboshaft engine 10 such that front surface 110, rear surface 112, and outer casing 18 together define a path for air to pass from inlet 20 into core turbine engine 14. Front surface 110 can be exposed to very low temperatures during operation, increasing the potential for ice formation. As a result, center body 100 defines various fluid passageways for reducing or eliminating the formation of ice on front surface 110, as described in detail below.

As illustrated in FIG. 3, center body 100 defines one or more inlet conduits 120, each of which define an inlet passageway 122. Inlet conduits 120 extend substantially along the axial direction A from a rear surface 112 toward a front surface 110 of center body 100. It should be appreciated, that as used herein, terms of approximation, such as "approximately," "substantially," or "about," refer to being within a ten percent margin of error. In addition, inlet conduits 120 place inlet passageways 122 in fluid communication with fluid supply pipe 102 for receiving warm bleed air 104 from high pressure turbine 28. According to the illustrated embodiment, center body 100 includes five inlet conduits 120 spaced along the circumferential direction C. However, it should be appreciated that any suitable number, size, and orientation of inlet conduits 120 may be used according to alternative embodiments.

Referring still to FIG. 3, center body 100 defines an annular distribution ring 124 that is formed about the axial direction A and defines an annular plenum 126. According to the illustrated embodiment, annular plenum 126 is in fluid communication with each of the inlet passageways 122 for distributing the flow of bleed air 104 uniformly throughout the annular plenum 126 of center body 100. After the warm bleed air 104 is distributed throughout annular plenum 126, it is used to heat portions of center body using an impingement structure 130, as described below according to an exemplary embodiment.

Referring now generally to FIGS. 3 through 6, impingement structure 130 will be described according to an exemplary embodiment. In general, impingement structure 130 includes a plurality of inner fluid conduits 132 and a plurality of outer fluid conduits 134. According to the illustrated embodiments, inner fluid conduits 132 and outer fluid conduits 134 both extend substantially along the radial direction R adjacent to each other. In addition, inner fluid conduits 132 are generally positioned aft of outer fluid conduits 134 along the axial direction A.

Figure 5:
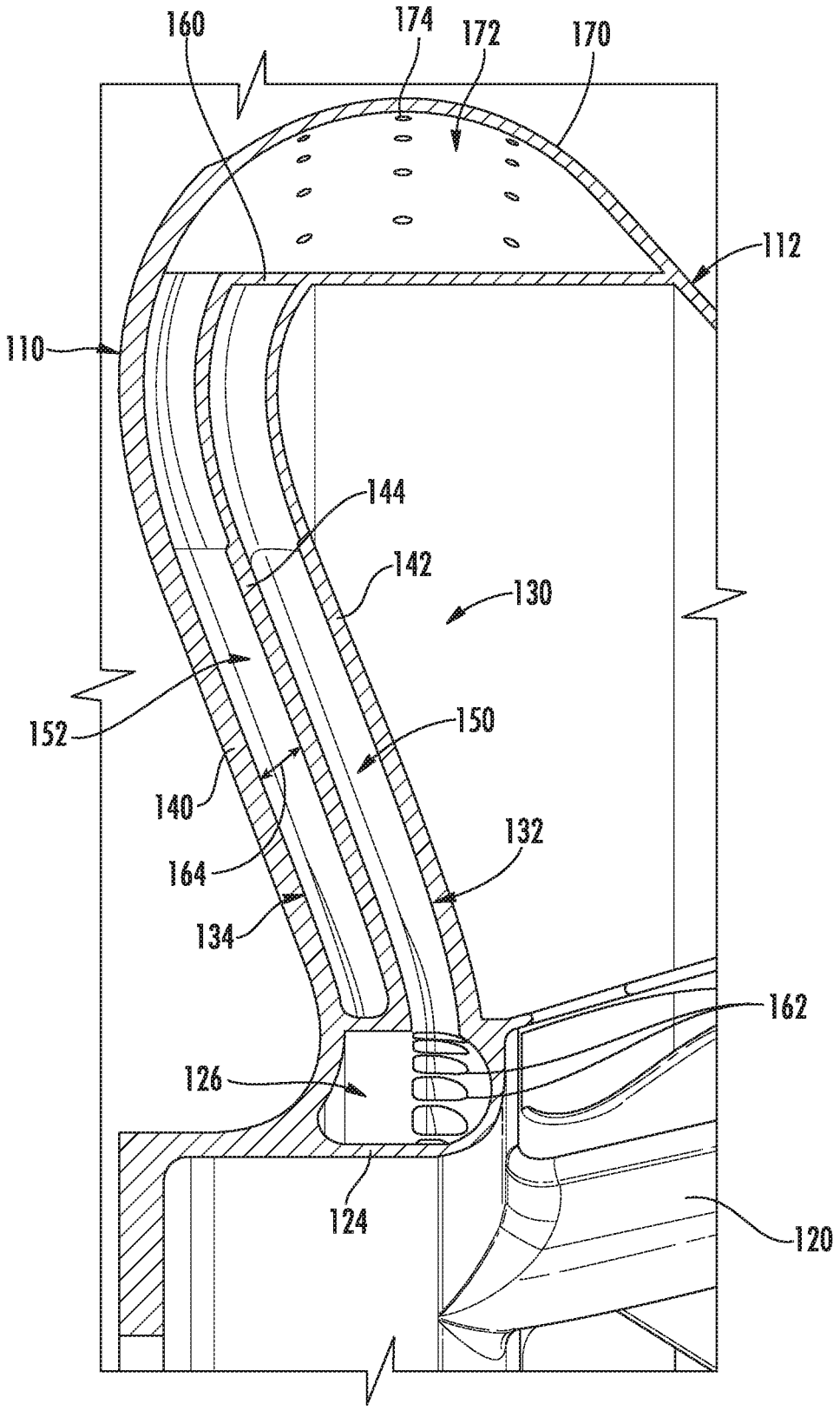
FIG. 5 provides a close-up, perspective view of an impingement structure of the exemplary center body of FIG. 2 according to an exemplary embodiment of the present subject matter.

More specifically, referring to FIG. 5, impingement structure 130 defines an outer wall 140 and an inner wall 142 spaced apart from outer wall 140 along the axial direction A. In addition, an impingement wall 144 is positioned between outer wall 140 and inner wall 142. In this manner, inner fluid conduits 132 are generally defined at least in part by inner wall 142 and impingement wall 144 to define a fluid distribution passageway 150. In addition, outer fluid conduits 134 are generally defined at least in part by outer wall 140 and impingement wall 144 to define an impingement gap 152. Using the additive manufacturing methods described herein, outer wall 140, inner wall 142, impingement wall 144, and fluid conduits 132, 134 may be any suitable size and shape. For example, according to the illustrated embodiment, walls 140-142 and fluid conduits 132, 134 are curvilinear, but could be straight, serpentine, or any other suitable shape according to alternative embodiments.

Figure 6:
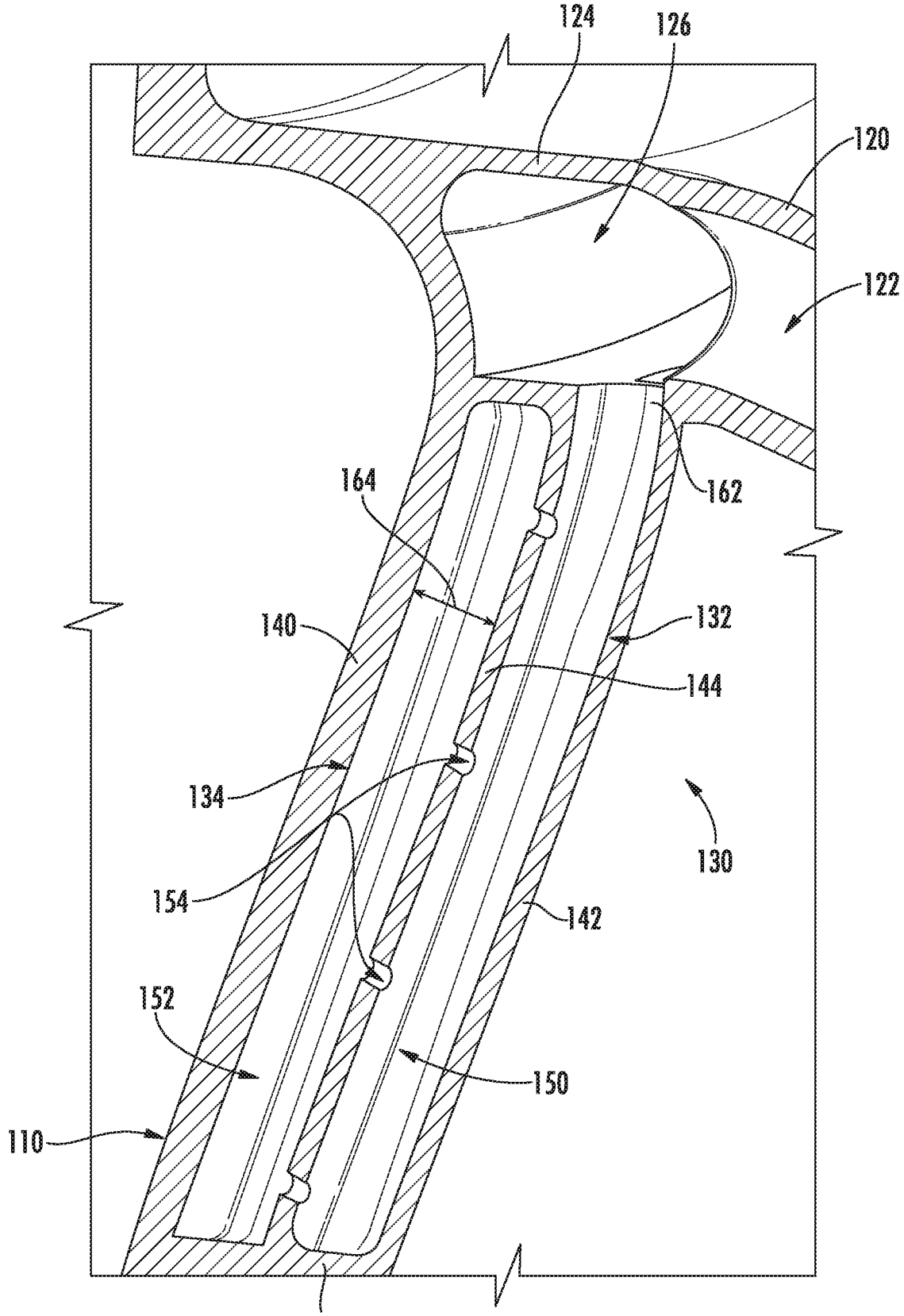
FIG. 6 provides another close-up, perspective view of an impingement structure of the exemplary center body of FIG. 2 according to an exemplary embodiment of the present subject matter.

Notably, impingement wall 144 is shared by inner fluid conduits 132 and outer fluid conduits 134. As shown in FIG. 6, impingement wall 144 further defines a plurality of impingement holes 154 that provide fluid communication between fluid distribution passageway 150 and impingement gap 152. According to the illustrated embodiment, impingement holes 154 are uniformly spaced along the radial direction R and extend along a direction perpendicular to impingement wall 144 to provide uniform cooling, as described below.

As best illustrated in FIG. 5, fluid distribution passageway 150 is in fluid communication with annular plenum 126 for receiving the flow of warm bleed air 104. More specifically, inner fluid conduits 132 are each fluidly coupled to annular distribution ring 124 and extend outward along the radial direction R to an end wall 160. By contrast, impingement gap 152 is not in direct fluid communication with annular plenum 126. Instead, the flow of bleed air 104 is distributed throughout fluid distribution passageway 150 and directed into impingement gap 152 through impingement holes 154. In this manner, the flow of warm bleed air 104 is impinged on outer wall 140 to heat outer wall 140 (and thus front surface 110), reducing the likelihood of ice build-up.

According to an exemplary embodiment of the present subject matter, inner fluid conduits 132 and outer fluid conduits 134 include a plurality of conduits spaced about the circumferential direction C. In this manner, for example, a plurality of divider walls 162 may extend substantially perpendicular to impingement wall 144 between inner wall 142 and outer wall 144. Divider walls 162 may be spaced about the circumferential direction C to divide the flow of bleed air 104 from annular plenum 126 into each of the fluid distribution passageways 150. However, it should be appreciated that according to alternative embodiments, divider walls 162 could be removed and another support structure could be used to create one large radially extending plenum for distribution the flow of bleed air 104.

As illustrated, inner wall 140 and outer wall 142 are solid, continuous walls having no holes. More specifically, inner wall 142 is continuous between inlet conduit 120 and end wall 160 such that impingement air may not flow through inner wall 142. Similarly, outer wall 140 is continuous between inlet conduit 120 and a discharge plenum 172 (as described below) such that impingement air may not flow through outer wall 140. In this manner, all of the flow of warm bleed air 104 is impinged through impingement holes 154 before exiting center body in the manner described below. Notably, generating "hidden" impingement holes 154 is enabled by the additive manufacturing techniques described herein and improves the selective heating of center body 100 by directing the entire flow of bleed air 104 where desired. In addition, impingement gap 152 defines a height 164 measured between impingement wall 144 and outer wall 140 along a direction perpendicular to outer wall 140. According to an exemplary embodiment, height 164 is constant throughout impingement gap 152 to avoid flow restrictions. However, according to alternative embodiments, height 164 may be varied as desired.

Still referring to FIG. 5, center body 100 further defines a discharge housing 170 positioned at a distal end of center body 100 and fluid conduits 132, 134 along the radial direction R. Discharge housing 170 generally defines a discharge plenum 172 that is in fluid communication with impingement gap 152. In addition, discharge housing 170 defines a plurality of discharge ports 174 for discharging the flow of bleed air 104 from discharge plenum 172 and center body 100. As illustrated, discharge housing 170 discharges bleed air 104 back into the flow of inlet air into turboshaft engine 10 where reenters core turbine engine 14.

Impingement structure 130 is described above as being used to heat an outer wall 140 of center body 100 to avoid ice build-up. However, it should be appreciated that this is only one exemplary embodiment of the present subject matter and is not intended to limit the scope of the invention. Therefore, according to alternative embodiments, impingement structure 130 may be modified in any suitable manner for heating or cooling a surface or location of any other suitable component, in a gas turbine application or another suitable application.

Figure 7:
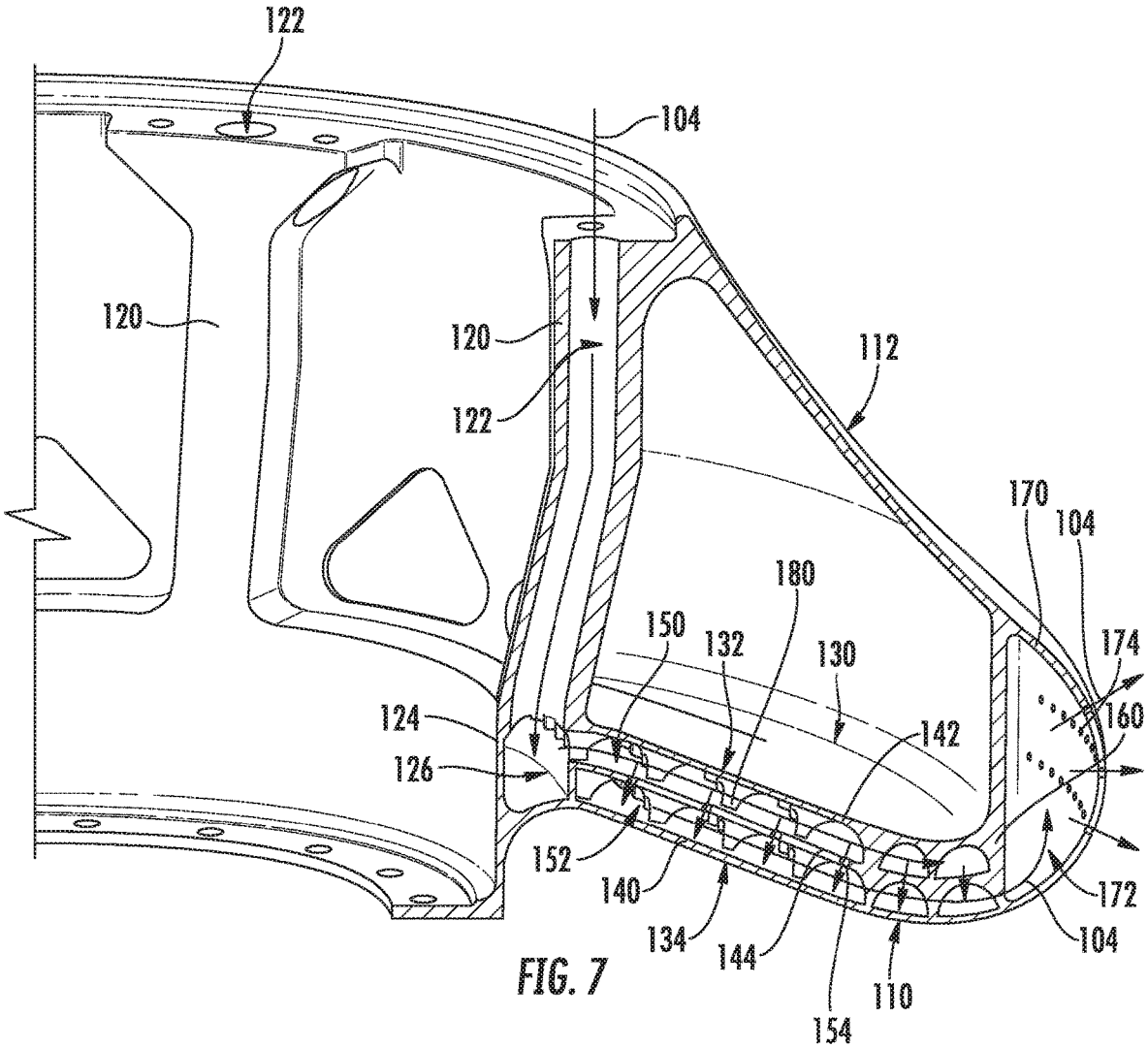
FIG. 7 provides another close-up, perspective view of an impingement structure of the exemplary center body of FIG. 2 according to an exemplary embodiment of the present subject matter.
Figure 8:
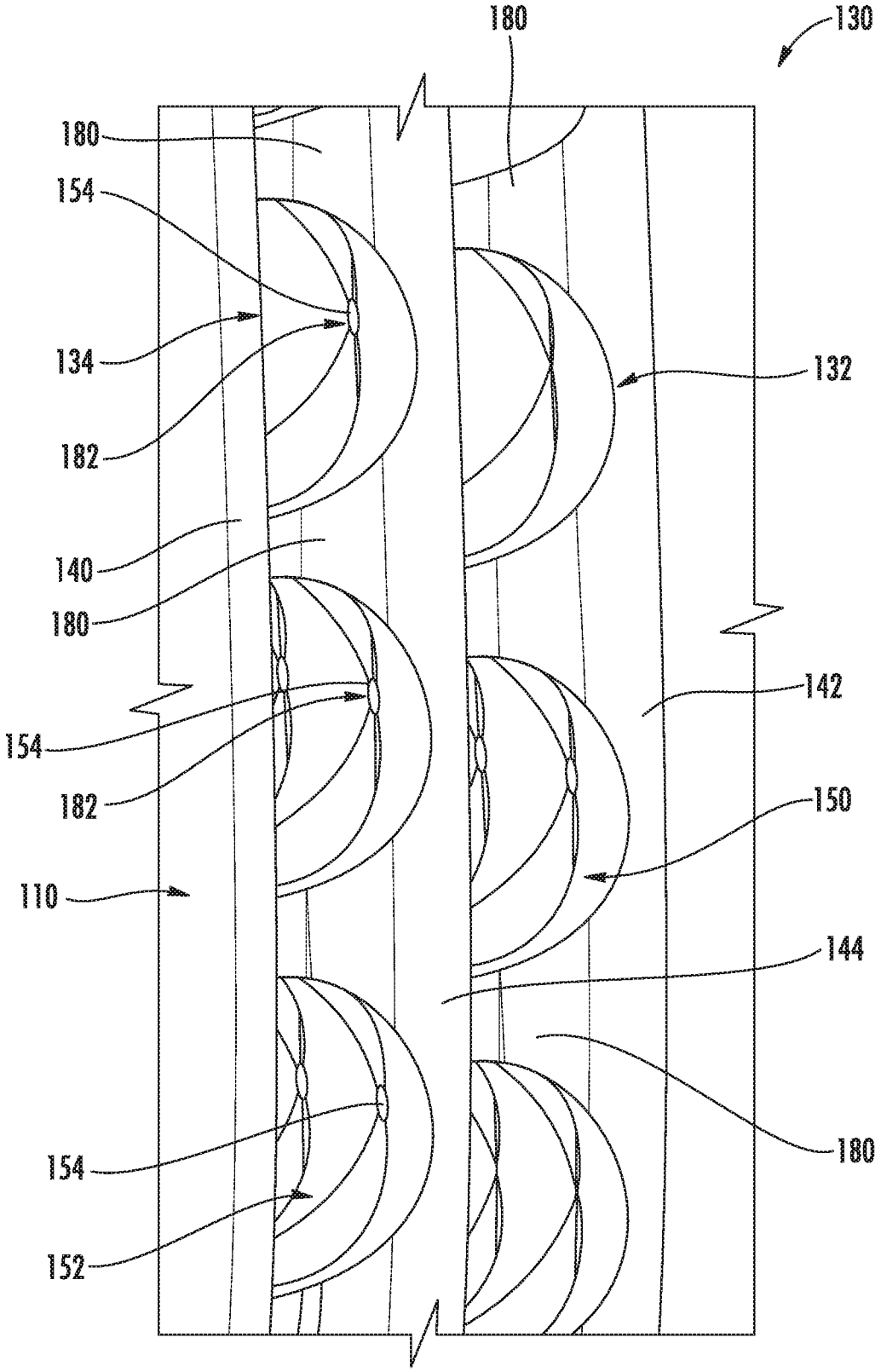
FIG. 8 provides another close-up, perspective view of an impingement structure of the exemplary center body of FIG. 2 according to an exemplary embodiment of the present subject matter.

Referring now to FIGS. 7 and 8, impingement control structure 130 according to an alternative embodiment of the present subject matter will be described. As illustrated, center body 100 includes one or more support structures, e.g., support struts 180, positioned within fluid distribution passageway 150 and impingement gap 152. Support struts 180 extend between impingement wall 144 and inner wall 142 in fluid distribution passageways 150 and between outer wall 140 and impingement wall 144 in impingement gap 152. Support struts 180 are generally shaped to provide structural support to impingement structure 130 and to facilitate simplified additive manufacturing. For example, according to the illustrated exemplary embodiment, support struts 180 form a cathedral, domed, or polygonal structure defining an apex 182. In addition, one or more impingement holes 154 are defined within impingement wall 144 at apex 182 of support struts 180. In this manner, structural support may be improved without affecting the efficacy of fluid impingement. According to alternative embodiments, support struts 180 may take the form of a stiffening matrix of material, internal fillets, or stiffening ridges within fluid distribution passageway 150 or impingement gap 152.

It should be appreciated that center body 100 is described herein only for the purpose of explaining aspects of the present subject matter. For example, center body 100 is used herein to describe exemplary configurations, constructions, and methods of manufacturing center body 100. It should be appreciated that the additive manufacturing techniques discussed herein may be used to manufacture other components for use in any suitable device, for any suitable purpose, and in any suitable industry. Thus, the exemplary components and methods described herein are used only to illustrate exemplary aspects of the present subject matter and are not intended to limit the scope of the present disclosure in any manner.

Now that the construction and configuration of center body 100 according to an exemplary embodiment of the present subject matter has been presented, an exemplary method 200 for forming a component according to an exemplary embodiment of the present subject matter is provided. Method 200 can be used by a manufacturer to form center body 100, or any other suitable component. It should be appreciated that the exemplary method 200 is discussed herein only to describe exemplary aspects of the present subject matter, and is not intended to be limiting.

Figure 9:
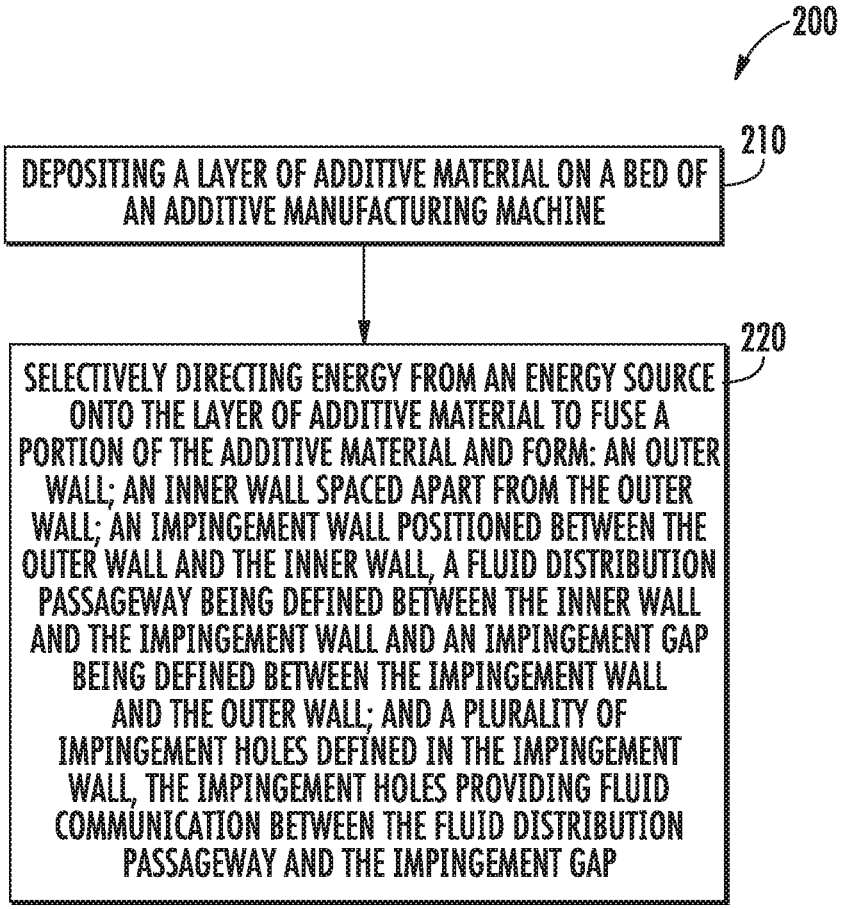
FIG. 9 is a method for forming an impingement structure according to an exemplary embodiment of the present subject matter.

Referring now to FIG. 9, method 200 includes, at step 210, depositing a layer of additive material on a bed of an additive manufacturing machine. Step 220 includes selectively directing energy from an energy source onto the layer of additive material to fuse a portion of the additive material and form a center body. For example, according to one embodiment, the center body may include an outer wall, an inner wall, and an impingement wall positioned between the outer wall and the inner wall. A fluid distribution passageway is defined between the inner wall and the impingement wall and an impingement gap is defined between the impingement wall and the outer wall. A plurality of impingement holes are defined in the impingement wall for providing fluid communication between the fluid distribution passageway and the impingement gap.

FIG. 9 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using center body 100 as an example, it should be appreciated that these methods may be applied to manufacture any suitable component.

An additively manufactured center body and a method for manufacturing that center body are described above. Notably, center body 100 may generally include internal fluid passageways and geometries that facilitate improved temperature control of desired components and whose practical implementations are facilitated by an additive manufacturing process, as described herein. For example, using the additive manufacturing methods described herein, the center body may include integral fluid passageways, distribution plenums, impingement walls, impingement holes, and unique configurations that improve thermal efficiency. These features may be introduced during the design of the center body, such that they may be easily integrated into the center body during the build process at little or no additional cost. Moreover, the entire center body, including the inlet conduit, the annular distribution ring, the outer wall, the inner wall, the impingement wall, the discharge housing, support structures, and other features can be formed integrally as a single monolithic component.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A component comprising:

an outer wall;

an inner wall spaced apart from the outer wall;

an impingement wall positioned between the outer wall and the inner wall, a fluid distribution passageway being defined between the inner wall and the impingement wall and an impingement gap being defined between the impingement wall and the outer wall;

a plurality of impingement holes defined in the impingement wall, the impingement holes providing fluid communication between the fluid distribution passageway and the impingement gap, the impingement holes defined in the impingement wall at an apex of one or more support struts, the one or more support struts defining a plurality of domed structures, each of the plurality of domed structures including a hemisphere-like shape;

a discharge housing defining a discharge plenum and a plurality of discharge ports, the discharge plenum being in fluid communication with the impingement gap, wherein:

the outer wall, the impingement wall, and the inner wall are integrally formed as a single piece of continuous metal to form a monolithic component; and the outer wall is continuous between an inlet conduit and the discharge plenum and the inner wall is continuous between the inlet conduit and an end wall such that a flow of impingement air may not flow through the outer wall or the inner wall.

2. The component of claim 1, wherein the inlet conduit defines an inlet passageway, the inlet passageway being in fluid communication with the fluid distribution passageway.

3. The component of claim 1, wherein the outer wall, the inner wall, and the impingement wall define an impingement structure, the impingement structure extending from the inlet conduit substantially along a radial direction and the discharge housing extending from the impingement structure substantially along the radial direction.

4. The component of claim 1, further comprising:

a plurality of divider walls extending substantially perpendicular to the impingement wall between the inner wall and the outer wall.

5. The component of claim 1, wherein the one or more support struts are positioned within the impingement gap and extending between the outer wall and the impingement wall, the one or more support struts positioned within the fluid distribution passageway and extending between the impingement wall and the inner wall.

6. The component of claim 1, wherein the inner wall, the impingement wall, and the outer wall are curvilinear.

7. The component of claim 1, wherein the impingement holes extend through the impingement wall substantially perpendicular to the impingement wall.

8. The component of claim 1, wherein the impingement gap defines a constant height measured between the impingement wall and the outer wall along a direction perpendicular to the outer wall.

9. The component of claim 1, wherein the outer wall is a nose cone, a booster casing, a compressor casing, a turbine casing, a frame, or a center body of a gas turbine engine.

10. A component comprising:

an outer wall;

an inner wall spaced apart from the outer wall;

an impingement wall positioned between the outer wall and the inner wall, a fluid distribution passageway being defined between the inner wall and the impingement wall and an impingement gap being defined between the impingement wall and the outer wall; and a plurality of impingement holes defined in the impingement wall, the impingement holes providing fluid communication between the fluid distribution passageway and the impingement gap, the impingement holes defined in the impingement wall at an apex of one or more support struts, the one or more support struts defining a plurality of domed structures, each of the plurality of domed structures including a hemisphere-like shape, wherein the inner wall and outer wall are solid, continuous walls having no holes.

11. The component of claim 10, further comprising:

an inlet conduit defining an inlet passageway, the inlet passageway being in fluid communication with the fluid distribution passageway.

12. The component of claim 11, further comprising:

a discharge housing defining a discharge plenum and a plurality of discharge ports, the discharge plenum being in fluid communication with the impingement gap.

13. The component of claim 12, wherein the outer wall, the inner wall, and the impingement wall define an impingement structure, the impingement structure extending from the inlet conduit substantially along a radial direction and the discharge housing extending from the impingement structure substantially along the radial direction.

14. The component of claim 12, wherein the one or more support struts are positioned within the impingement gap and extending between the outer wall and the impingement wall, the one or more support struts positioned within the fluid distribution passageway and extending between the impingement wall and the inner wall.

15. The component of claim 14, wherein the support struts form a domed structure defining the apex, one of the plurality of impingement holes being positioned at the apex.

16. The component of claim 10, wherein the inner wall, the impingement wall, and the outer wall are curvilinear.

17. The component of claim 10, wherein the outer wall is a nose cone, a booster casing, a compressor casing, a turbine casing, a frame, or a center body of a gas turbine engine.

* * * * *